United States Patent [19]

Pospischil et al.

[11] 4,175,989

[45] Nov. 27, 1979

[54] NEWSPAPER VENDING MACHINE

[75] Inventors: Albert R. Pospischil, South Beloit, Ill.; Michael L. Bruegman; Erlang W. Granberg, both of Beloit, Wis.

[73] Assignee: Precision Fabricators, Inc., South Beloit, Ill.

[21] Appl. No.: 890,183

[22] Filed: Mar. 27, 1978

[51] Int. Cl.[2] ..... G07F 1/04

[52] U.S. Cl. ..... 194/1 C; 194/1 D; 194/1 K; 194/DIG. 2; 194/DIG. 15

[58] Field of Search ..... 194/1 A, 1 B, 1 C, 1 D, 194/1 E, 1 F, 1 G, 1 K, 1 R, 2, 92, 93, 97 R, DIG. 2, DIG. 3, DIG. 15

[56] References Cited

U.S. PATENT DOCUMENTS

| | | | |
|---|---|---|---|
| 1,638,413 | 8/1927 | Schultz | 194/97 R |
| 1,790,725 | 2/1931 | Schermack | 194/1 A |
| 2,279,664 | 4/1942 | Du Grenier | 194/DIG. 2 |
| 2,982,389 | 5/1961 | Dietrich | 194/97 R |
| 3,788,333 | 1/1974 | Johnson | 194/1 D X |

*Primary Examiner*—Joseph J. Rolla

*Attorney, Agent, or Firm*—Allegretti, Newitt, Witcoff & McAndrews

[57] ABSTRACT

A coin receiver for use in a newspaper vending machine having a dispensing mechanism therein, the coin receiver comprising first and second frame members defining a chute for receiving coinage, said frame members being biased toward one another and being actuable away from one another to release coinage from the chute, lever members for extending into the chute to set the chute for receiving predetermined coinage, a receptacle for storing coinage, a first actuating rod operatively connected to one of said frame members for moving said frame member relative to the other frame member in response to actuation of the dispensing mechanism to discharge the coinage into said receptacle, and a second actuating rod operatively connected to said one frame member for moving the said one frame member further relative to said other frame members. Another aspect of the invention is the pressure relieving arrangement for taking tension off of the tray in operation to permit a newspaper to be more easily withdrawn from the top of the stack of newspapers in the newspaper vending machine.

7 Claims, 16 Drawing Figures

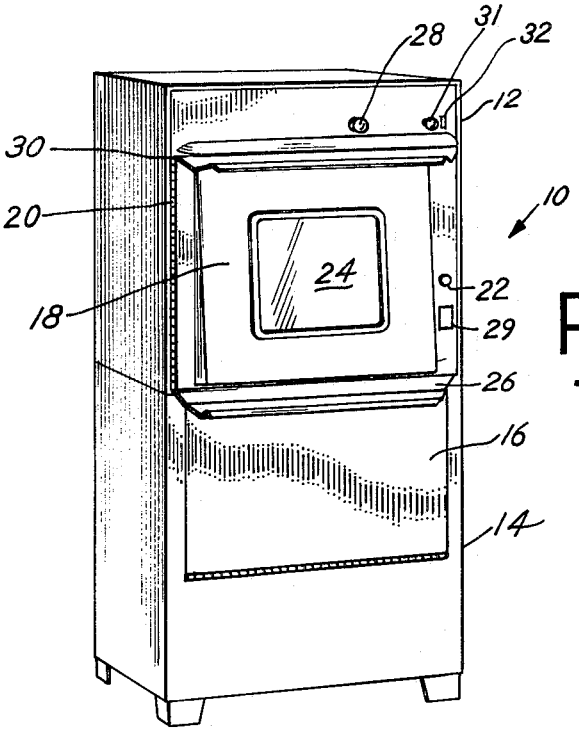
Fig. 1
Fig. 2
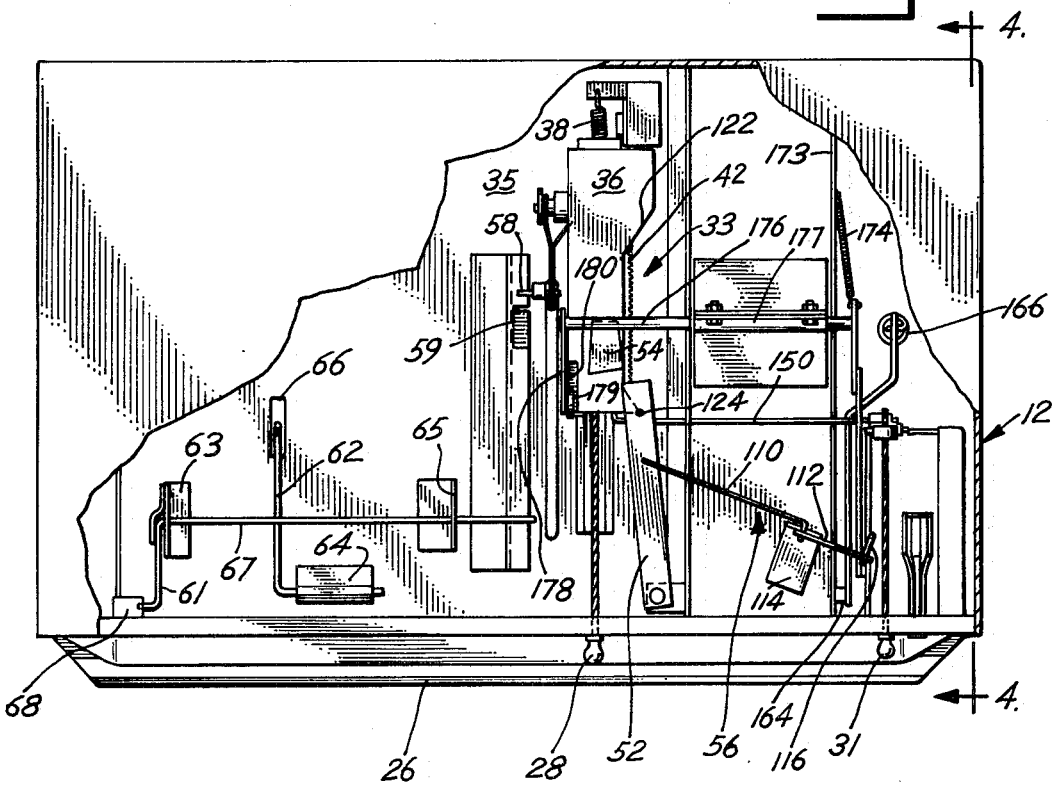

Fig. 8
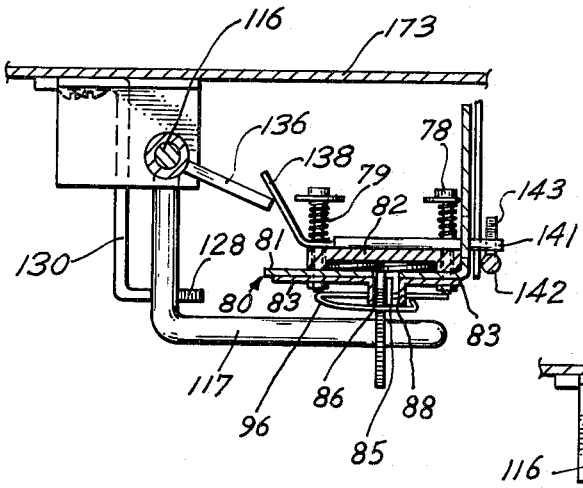
Fig. 9
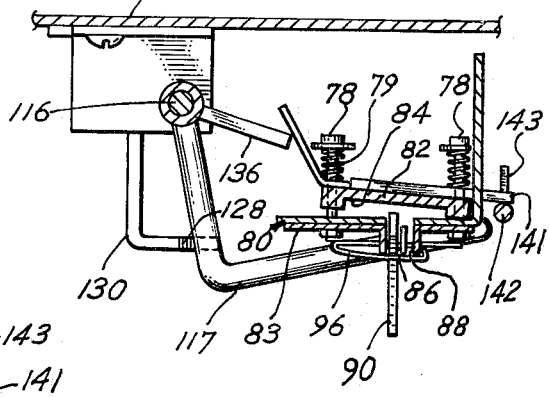
Fig. 10
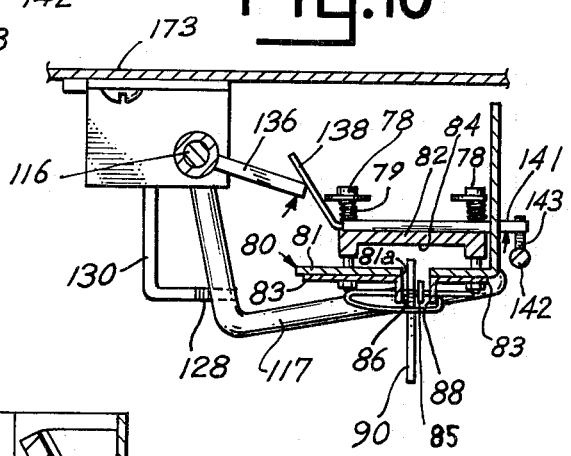
Fig. 11
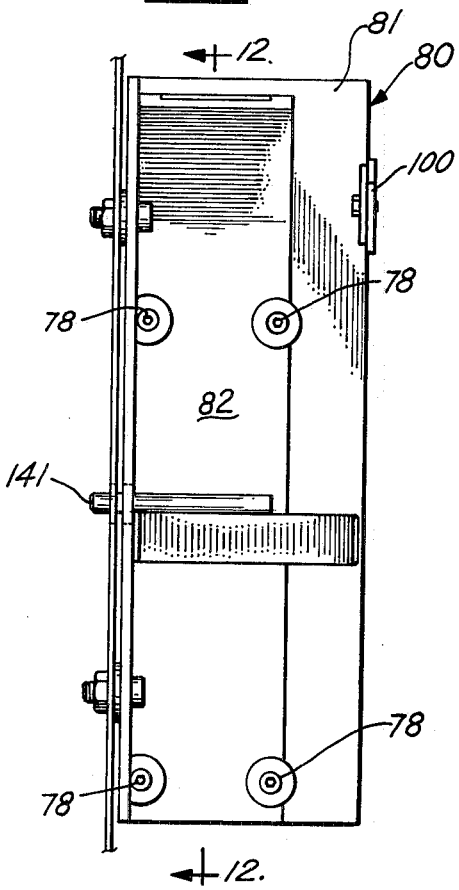
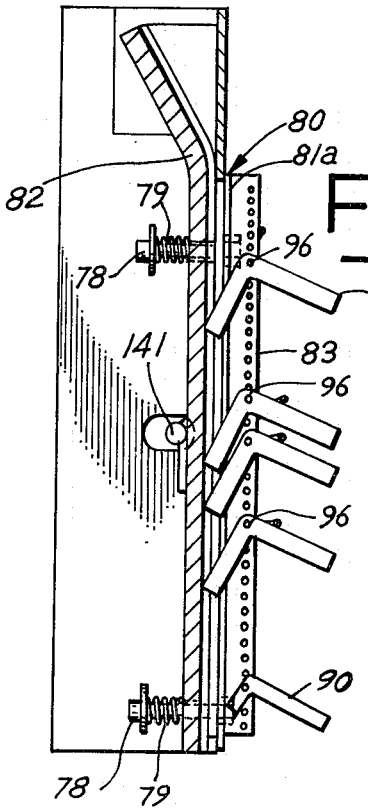
Fig. 12
Fig. 13
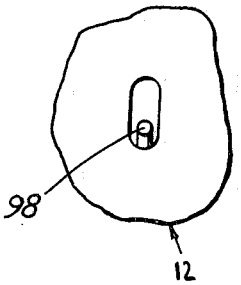

NEWSPAPER VENDING MACHINE

BACKGROUND AND SUMMARY OF THE INVENTION

This invention pertains to a newspaper vending machine and more particularly, to an improved newspaper vending machine having novel coin collector means for selectively receiving and retaining the proper coin for a single newspaper to be dispensed and readily coordinated with the operation of the vending machine.

Machines for vending newspapers and the like articles one at a time have been known for many years. One type of known device contains a stack of newspapers arranged vertically or stacked on edge so that when the proper coins are inserted into the machine, the forward most newspaper is discharged from the machine. Examples of this type of machine are found in Schultz U.S. Pat. Nos. 1,659,167; Schofield 1,882,261; Laughery 2,119,548; and Etes 3,023,928. Such machines constructed for end stacked newspapers were quite susceptible of jamming and were not sufficiently reliable for widespread commercial use.

Another type of newspaper vending machine incorporated a magazine or rack for supporting newspapers horizontally within the machine and selectively discharging one newspaper at a time from the bottom of the magazine or rack. The Weaver U.S. Pat. No. 2,546,352 reveals this type of machine. This machine requires a stack of newspapers received from the publisher to be split and loaded by hand, one at a time into the magazine or rack. Extra handling and expense are incurred by the machine owner operator.

Various machines are known for dispensing a single newspaper one at a time from the top of a stack of newspapers, magazines or the like. In Navi U.S. Pat. No. 3,960,291, the newspapers are partially overlapped symmetrically about a vertical plane of symmetry and urged upwardly against a horizontally traveling stripper or dispensing assembly by a resilient platform. A disadvantage of this machine is the requirement for manually arranging the stack of newspapers received from the newspaper publisher.

Croft, U.S. Pat. Nos. 1,553,310; Etes et al 2,870,939 and Etes 3,114,475 show newspaper vending machines for dispensing a single newspaper from the top of a horizontally arranged stack of newspapers. Each machine includes a dispensing mechanism provided with a needle for impaling the topmost newspaper on the stack and moving it to a position where it can be received by the person desiring the newspaper. In Croft and Etes et al U.S. Pat. No. 2,870,939, the dispensing mechanisms include a plurality of needles for moving a newspaper horizontally through a dispensing opening. The user pulls the lead edge of the newspaper extending through the dispensing opening so as to move the newspaper parallel to the stack and remove it from the machine. In Etes U.S. Pat. No. 3,114,475, the dispensing mechanism includes a single needle for moving the top newspaper off the stack with a twisting motion. The present invention improves upon the coin receiver of the general type disclosed in Etes U.S. Pat. No. 3,114,475, which is susceptible of jamming under a number of operating conditions, and upon the means for removing the topmost newspaper from the stack of newspapers by relieving some pressure from the spring urging the tray supporting the stack of newspapers upwardly during the dispensing operation.

Newspaper vending machines that discharge a single newspaper from the top of a stack appear to have most commercial potential, but to date have found only limited appeal due to internal complexity and unreliability.

In addition, the modern newspaper vending machine must have a reliable coin receiver that is sturdy to withstand abuse and is readily adjustable to permit use for one value of coins during the week, and a different value of coins on weekends, as well as to be adjustable for different values so as to be used conveniently throughout the country. The coin receiver must be non-jamming and adapted to easily clear any jam of coins in normal operation. The operation of the coin receiver must be unified with that of the newspaper vending machine including the dispensing mechanism so as to enhance the functioning, reliability and usefulness of the entire machine.

An object of this invention is to provide an improved newspaper vending machine having a unique coin receiver wherein significant deficiencies and disadvantages in prior constructions are obviated.

Another object of this invention is to provide an improved newspaper vending machine including therein a unique coin receiver that is selectively adjustable over a wide range to accept coins of different value (and size) and accept different values for weekly and weekend newspapers.

A further object of this invention is to provide an improved coin control apparatus for a newspaper vending machine that is coordinated with the dispensing mechanism of the newspaper vending machine to lock the dispensing mechanism against movement in the absence of the predetermined desired coins in the coin receiver and that permits insufficient or improper coins to be returned to the user easily.

Another object of the present invention is to provide an improved coin receiver for a newspaper vending machine that can be readily cleared of any jams that may occur in normal operation.

Yet another object of the present invention is to provide an improved newspaper vending machine with pressure relieving means for facilitating removal of the topmost newspaper from the stack of newspapers on the tray in the vending machine. Other objects and advantages of the present invention will be made more apparent hereinafter.

BRIEF DESCRIPTION OF THE DRAWING

There is shown in the attached drawing a presently preferred embodiment of the present invention wherein the like numerals in the various views refer to like elements and wherein:

FIG. 1 is a perspective view of a newspaper vending machine embodying principles of the present invention;

FIG. 2 is a plan view of the newspaper vending machine with parts broken away to better illustrate the dispensing mechanism;

FIG. 8 is a top view of the coin receiver, partially in section, illustrating coins retained in the coin receiver;

FIG. 9 is a top view of the coin receiver, partially in section, illustrating the full release position;

FIG. 10 is a top view of the coin receiver, partially in section, illustrating the full release position;

FIG. 11 is a rear view of the coin receiver;

FIG. 12 is a cross-sectional view taken generally along the line 12—12 of FIG. 11 and illustrating the position of the coin receiver amount setting or stop levers;

FIG. 13 is a detail view of the inside of the newspaper vending machine illustrating the Daily-Sunday lever;

DETAILED DESCRIPTION OF THE PRESENT INVENTION

Figure 3:
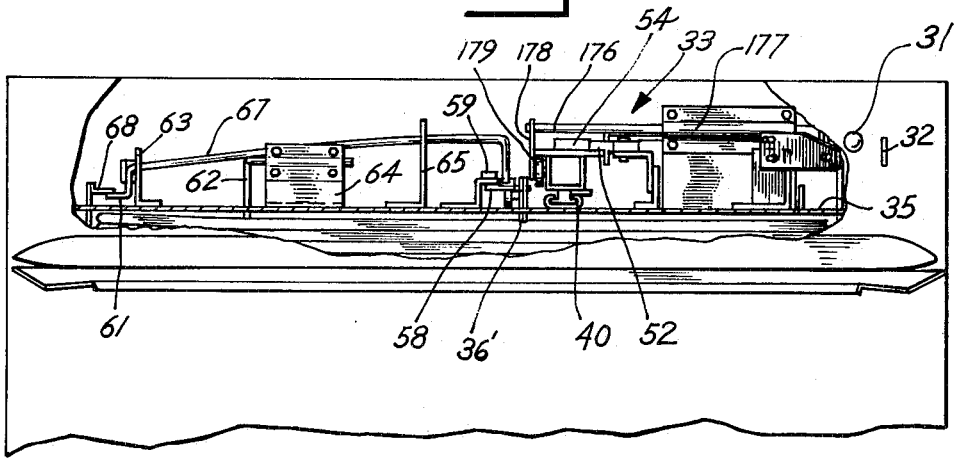
FIG. 3 is a fragmentary elevation view of the newspaper vending machine, with parts broken away to better illustrate the dispensing mechanism.

With reference to FIG. 1, there is illustrated a vending machine 10 which is adapted for dispensing newspapers, magazines or the like and which will hereinafter be referred to as a newspaper vending machine. The vending machine 10 is comprised basically of two components, an upper vending component 12 and a lower storage component 14. The lower storage component 14 comprises a box-like housing having a front opening door 16 which pivots at the lower end thereof on the front of the housing. Extra newspapers or other articles may be stored in the lower portion of the housing 14. Resting on the housing 14 at a height convenient to the user, is the vending component 12.

The vending machine component 12 of the newspaper vending machine 10 comprises a box-like member having a door 18 pivoted on the front thereof and adapted to be swung on the hinges 20 by means of a key inserted into door lock 22. Within the door 18 is a compartment for carrying a display copy of a newspaper which may be visible through the glass 24 on the face of the door. The tray 26 forms a part of the door and extends downwardly and forwardly thereof. As will be explained hereinafter, when all of the newspapers within the vending component 12 have been dispensed, the display copy will be released from the storage compartment within the door 18 and be discharged on to the tray 26 where it may be grasped by the user.

Provided in the front of the vending component is a pull lever 28 which is adapted to actuate the dispensing mechanism within the vending component 12 to discharge a newspaper from the top of a horizontally disposed stack of newspapers within the vending component one at a time through the discharge opening 30 at the front of the vending component 12. To the right of the pull lever is a coin return lever 31 and a coin slot 32. The returned coins may be obtained through coin slot 29 in the door 18.

The vending machine 10 is constructed and arranged so as to dispense newspapers selectively one at a time depending upon the insertion of proper coins into the coin slot 32. The coin collector within the vending machine may be readily adjusted to accommodate the proper coins for daily newspapers and for weekend newspapers, for example, in some communities the daily newspaper may be $0.15, whereas the weekend newspaper may be $0.50. The vending machine 10 is adapted to be readily adjusted so as to accommodate the proper denomination of coins to selectively dispense the desired newspaper by the operator.

With reference now to FIGS. 2, 3, 4 and 5, the construction of the vending machine 10 may be better understood. The dispensing mechanism 33 is mounted on a panel 35 in the vending component 12. Basically, the dispensing mechanism 33 includes a feed finger 36' carried on a reciprocable carriage 36, which feed finger is adapted to be moved downwardly to impale the top newspaper in the stack. The pull lever 28 is affixed to the carriage 36 through a lost motion connection for moving same toward the front of the vending component 12 while tensioning spring 38, and the spring 38 will function to restore the carriage 36 to its initial position after release of the pull lever 28. The carriage 36 rides or reciprocates in a trackway 40 on the panel 35. The carriage 36 includes a rack 42 which cooperates with a pawl to prevent retrograde or return motion of the carriage 36 during a paper removing operation so as to prevent more than one paper from being withdrawn for the requisite fee received in the coin receiver 50 in the vending component 12.

In the event there are no coins in coin receiver 50 or insufficient coins in the coin receiver 50, lever 52 will engage stop 54 on the carriage 36 and prevent forward motion of the carriage 36. If there is sufficient coinage in the coin receiver 50, lever 52 will be held out of a position where it could engage stop 54 by linkage 56. During forward movement of carriage 36, pin 58 will cooperate with cam 59 to force the feed finger downwardly into engagement with the top newspaper to pivot an end thereof through the opening 30 in the door 18. The operator grasps an end of the newspaper and pulls it from the opening. When the pull lever 28 is released, spring 38 will operate to return the carriage 36 to its initial position.

Means are provided for releasing the newspaper contained in the door compartment. Such means comprises a lever 62 pivoted in bracket 64 on top panel 35 and extending through opening 66 therein so as to rest on the top newspaper in the stack. When the last newspaper is withdrawn from the stack, the lever 62 will drop downwardly. Lever 67 is retained in a slot in bracket 65 and is pivoted in bracket 63. During forward movement of the carriage 36, the pin 58 on the carriage 36 engages and rotates the end of arm 67 to raise the left end of arm 67 as viewed in FIG. 2 and thereby raise the elongated lever 68. The lever 68 cooperates with a release in the door 18 to release the newspaper within the door.

A feature of this invention is the improved coin receiver 50 which is mounted in the vending component 12 along the right side.

With reference now to FIGS. 4–12, there is better shown the coin collector or coin receiver of the present invention. The coin receiver 50 is adapted to receive coins from the upper coin chute 70 that communicates with the slot 32 at the front panel of the vending component 12. The coinage will pass from the chute 70 through a slug detection mechanism 75 into the coin receiver 50 of the present invention. Coins discharged from the coin receiver 50 are adapted to be discharged into a coin collection box 76, or alternatively, to be returned to the coin return slot 29 at the front of the newspaper vending machine 10 where it may be retrieved by the operator. The coin collection box 76 is positioned to underlie the chute defined in the coin receiver 50.

Figure 6:
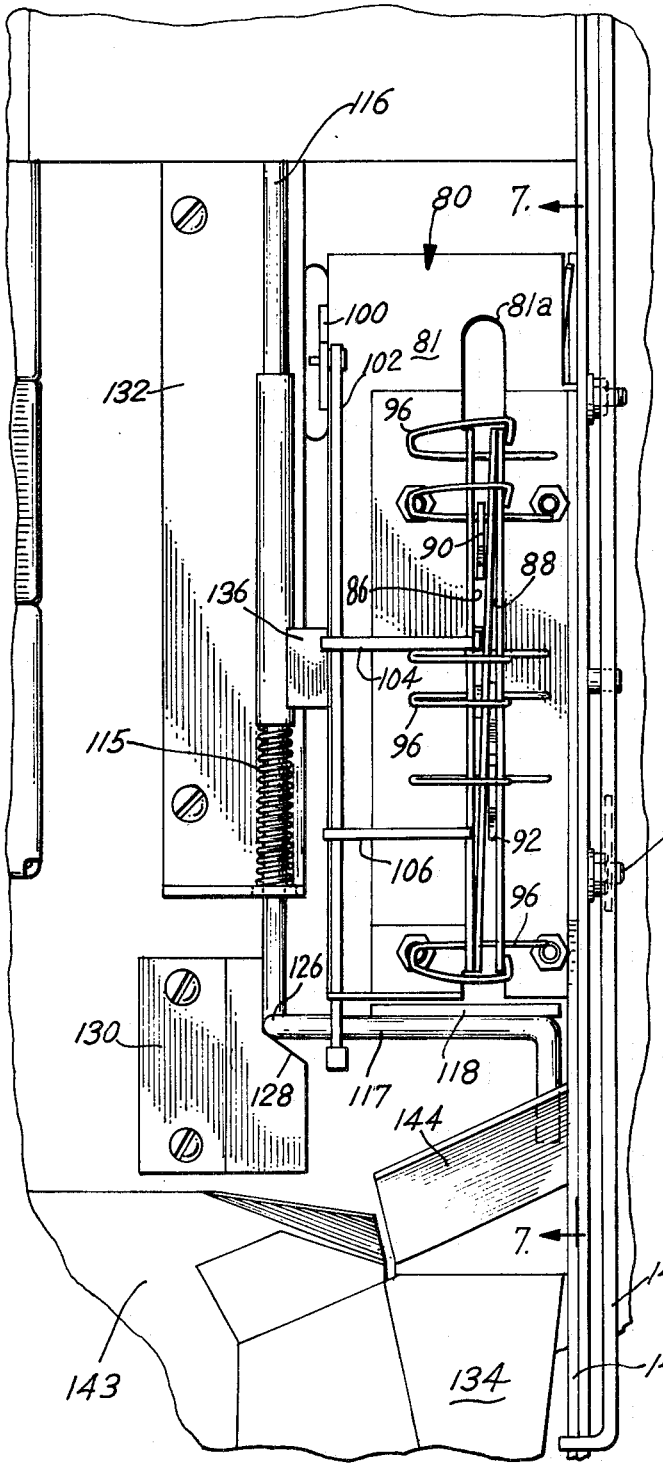
FIG. 6 is a detail elevation view of the improved coin receiver of the newspaper vending machine.
Figure 7:
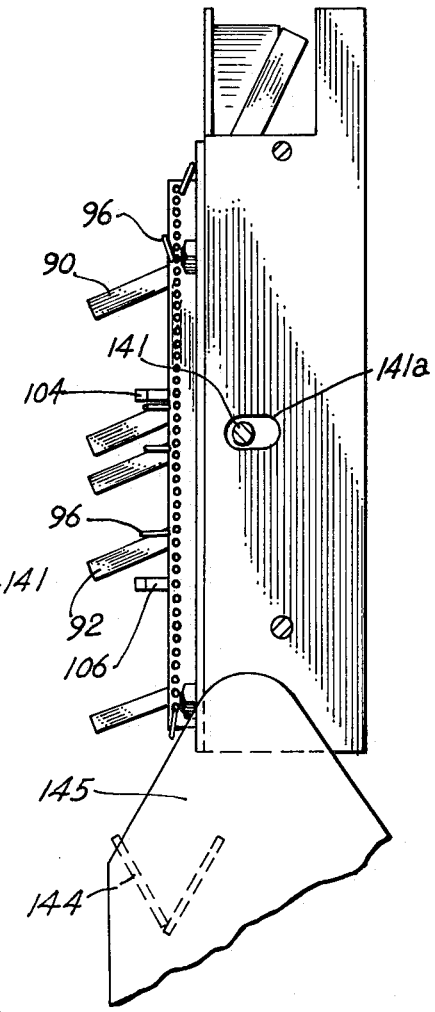
FIG. 7 is a detail view of the coin receiver taken generally along the line 7—7 of FIG. 6.

The coin receiver 50 comprises a pair of frame means 80, 82 which define a coin chute 84 therebetween. Frame means 80 comprises a frame plate 81 with a slot 81*a* therein and a pair of plates 83 secured thereto and spaced apart centrally of frame plate 81 to define slot means in alignment with the slot in the frame plate 81. A spacer 85 is provided between opposed walls of the angled plates 83 to define a pair of slots 86, 88 which are adapted to receive coin stop fingers 90, 92 therein as best seen in FIG. 6. The frame means 80, 82 are held in assembled relationship by bolts 78 secured to frame means 80 and extending loosely through openings in frame means 82 and springs 79 on the bolts 78 that bias the frame means toward one another.

The slot 88 may be referred to as the daily slot and slot 86 may be referred to as the Sunday slot. The stop springs 96 are adapted to be adjustably positioned along the slots 86, 88 to retain the stop fingers in predetermined position to adapt the vending machine 10 for operation with different dominations of coins or with different coins for both daily operation and Sunday operation, depending upon the position of the daily/-Sunday knob 98, as best shown in FIG. 13. The knob 98 is disposed in the inside right-hand panel of the vending component 12 of the vending machine 10 and operatively connected to the coin receiver 50 as will be set forth more fully hereinafter.

The knob 98 pivots lever 100 on frame plate 81 to appropriately position rod 102 and pawls 104, 106 carried for either daily or Sunday operation. If knob 98 is moved downwardly (for Sunday operation), the rod 102 and the pawls 104 and 106 carried thereon will be raised into engagement with the associated daily levers 90. That is, the inner end of the daily levers will not interfere with coins in the daily slot, locking them out of position. The Sunday lever 92 will be operative to receive the proper preset coinage for Sunday operation.

If knob 98 is raised for daily operation, the rod 102 will be moved downwardly to release all levers 90,92 and the coin receiver 50 will be operative for daily use.

Linkage 56 comprises a link 110 connected to a link 112 pivoted on bracket 114. Rod 116 is connected at its upper end to link 112. The lower end of rod 116 is offset as shown at 117 and carries a block 118 thereon adapted to engage the coinage projecting from the bottom of the coin receiver 50 and resting on block 118. When there is proper coinage in coin receiver 50, and pull rod 28 is pulled, rod 116 will be held in its lowermost position with the coins between the block 118 on arm 117 of rod 116 and the associated stop fingers 90, 92 in the coin receiver 50. Lever 52, operatively connected to the rod 116 by linkage 56, will be retained out of engagement with projection 54 and carriage 36 may be pulled forwardly to actuate the feed finger (FIG. 2).

At the end of the forward pull of pull knob 28, the cam 122 on the carriage 36 will engage pin 124 projecting downwardly from lever 52 to pivot the lever 52 clockwise as shown in FIG. 2. Links 56 will be actuated to move rod 116 downwardly. The bend of the arm 116, as indicated at 126, will ride down cam 128 on bracket 130 to pivot rod 116 journalled in brack 132 to move block 118 out of alignment with the chute in coin receiver 50. The coins will be discharged through entry funnel 134 into collection box 76. Entry funnel 134 is secured to the coin receiver 50 in vending compartment 12. The collection box 76 is removable when door 18 is opened to permit the operator to empty same. Spring 115 urges the elongated rod 116 upwardly to restore it to its initial up position after downward actuation via linkage 56.

It is noted that as rod 116 is rotated by cam 128 cooperating with bend portion 126, flap 136, which is secured to the rod 116, will engage with extension flap 138 secured to frame part 82 and move frame part 82 relative to frame part 80 to widen the chute and faciliate discharge of the coins from the chute in coin receiver 50 into the coin collection box 76 (FIG. 9).

Figure 4:
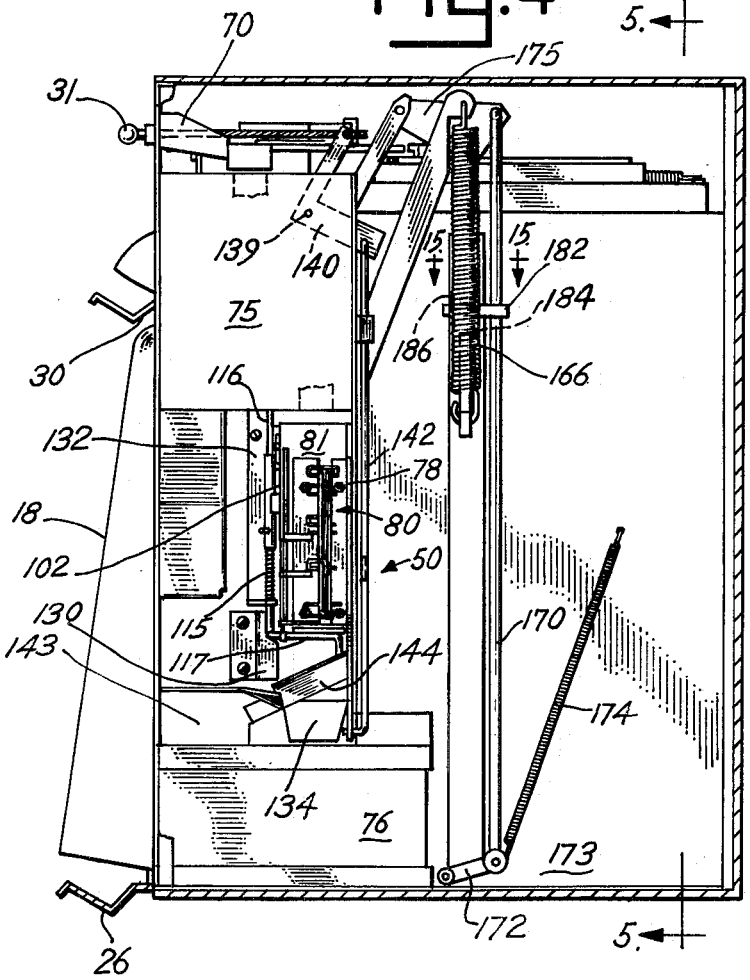
FIG. 4 is a detail view of the newspaper vending machine taken generally along the line 4—4 of FIG. 2.
Figure 5:
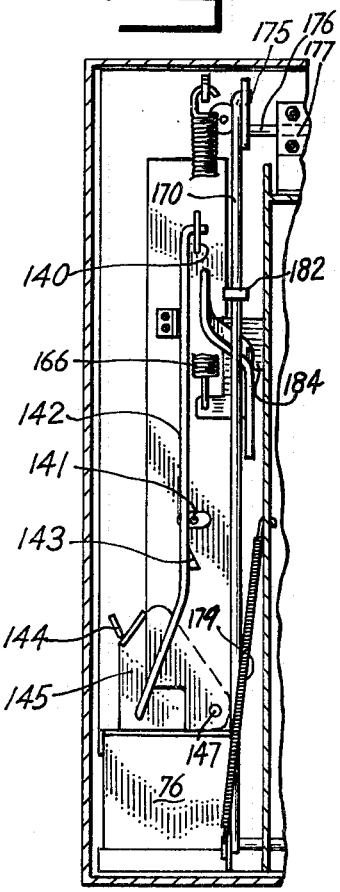
FIG. 5 is a detail cross-sectional view taken generally along the line 5—5 of FIG. 4.

Should insufficient coins or improper coins inserted into coin slot 32 enter coin receiver 50, and it be desired to retrieve them, the operator may actuate coin return lever 31. Coin return lever 31 is connected to angle lever 140 pivoted in the vending compartment 12 as indicated at 139 (FIG. 4). Lift rod 142 is connected at its upper end to lever 140 and at its lower end to coin return guid 144 which is pivotally supported below coin receiver 50. When coin return lever 31 is pulled, lift rod 142 is raised and return guide 144 is pivoted into alignment with the chute in coin receiver 50. The coin return guide 144 comprises a V-shaped or trough part extending transversely from planar member 145 that is pivotally connected to a wall member in the vending component 12 as indicated at 147 (FIG. 5). Cam 143 secured to the rod 142 engages a pin 141 on an end of the frame member 82 to urge the right end of the frame member 82 from the right end of frame member 80. At the same time, the return guide 144 engages arm 117 to pivot rod 116 as shown in FIG. 10 to fully move the frame parts 80, 82 away from one another and assure emptying of the chute in the coin receiver 50.

With reference to FIG. 2, rod 150 is reciprocably supported in brackets on the top panel 35. Rod 150 is actuated by carriage 36 and moved to the right as seen in FIG. 2 to lock the coin return lever 140 and thus, prevent a user from operating the coin return knob 31 while he is withdrawing a newspaper from the vending machine. After the carriage 36 is restored to its initial position, spring 152 will urge the rod 150 to the left as viewed in FIG. 2 to release the rod 150 from locked position with coin return lever 140 and thereby permit operation of the coin return lever if desired.

Figure 14:
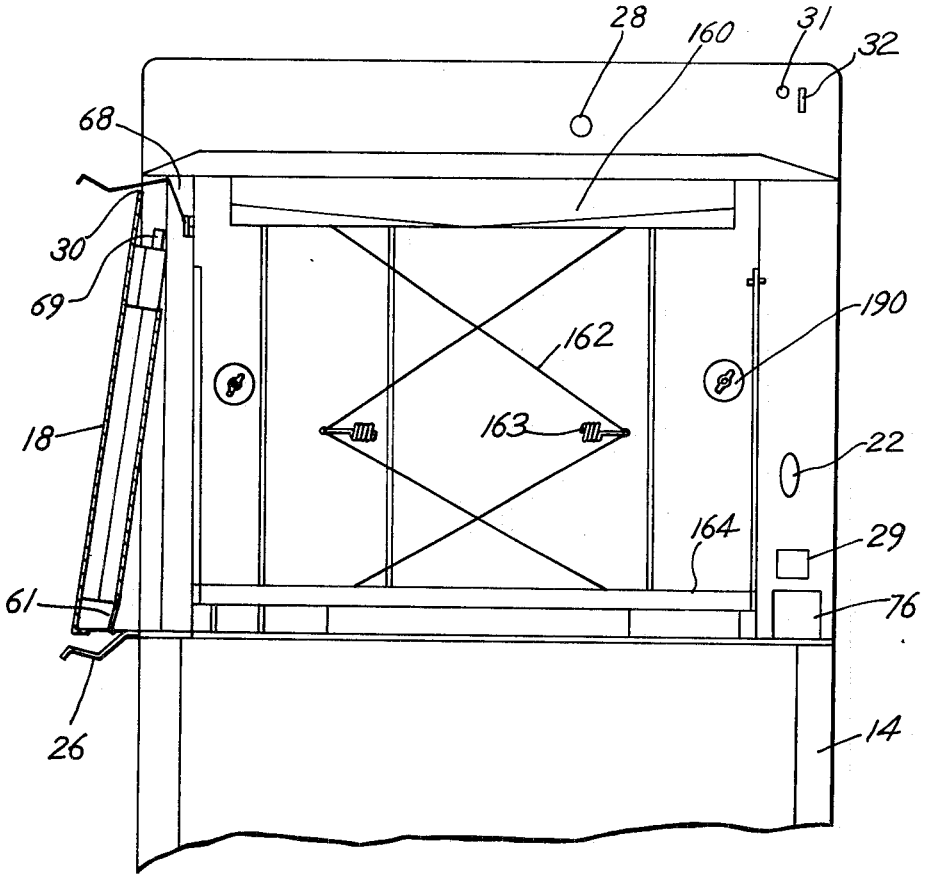
FIG. 14 is a schematic side view of the newspaper vending machine, with the door shown open and in cross-section.

FIG. 14 illustrates schematically a front view of the vending machine 10 with the door 18 open. For purposes of illustration, the door 18 is shown in cross-section. Newspapers are carried on try 160. The tray 160 is supported within the vending compartment 12 by means of a single scissors linkage 162. Spring 163 biases the linkage 162 so as to urge the tray 160 upwardly. U-shaped linkage 164 is raised when papers are stacked on tray 160 and then lowered to the position shown in FIG. 14 to bias the springs 166 (FIG. 4) for raising the tray 160 with the newspapers thereon toward the upper position shown in FIG. 14.

The wing screws 190 function to secure the vending subassembly in the outer housing 12. Newspaper pressure relieving means are provided to take tension off the tray 160 during operation and permit a newspaper to be withdrawn more easily from the top of the stack. The pressure relieving means (FIGS. 4, 5, 15 and 16) include a vertical rod 170 pivoted at its lower end to rod 172 that is pivoted to the side wall 173 in the vending machine 10. Spring 174 biases the rod 170 upwardly as shown in FIGS. 4 and 5. The upper end of rod 170 is pivoted to bracket 175 that pivots on rod 176 (FIGS. 3 and 5). The rod 176 is journalled in bracket 177 on top 35 in vending machine 10. At an end, link 178 is secured to the rod 176 and carries a roller 179 adapted to cooperate with carriage 36.

Figure 15:
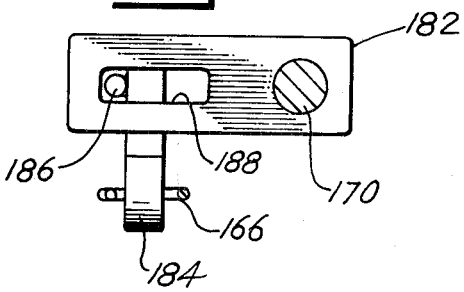
FIG. 15 is a detail view of a part of the pressure relieving mechanism taken generally along the line 15—15 of FIG. 4, illustrating the working position of the components to relieve some pressure on the tray for the stack of newspapers.
Figure 16:
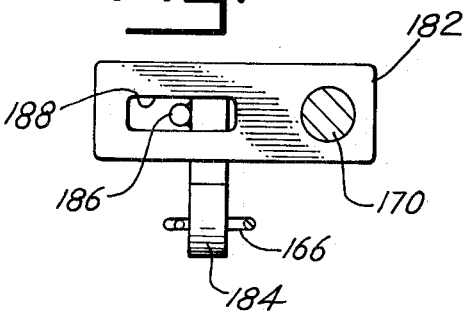
FIG. 16 is a detail view similar to FIG. 15 illustrating the idle position of the components for relieving pressure on the tray for the stack of newspapers.

When the carriage 36 is moved forwardly, roller 179 (FIG. 2) engages cam face 180 on carriage 36 to pivot rod 176. Pivoting of rod 176 will lower rod 170 causing rod 170 to engage lost motion link 182 and lower the tray 160 connected to arm 184. The bracket 175 and the link 172 are constructed and arranged so that there is a longer effective arm at the top than at the bottom. FIG. 16 illustrates the normal position of arm 184 and rod 170 relative to lost motion link 182. The pin 186 on arm 184 is to the right in slot 188 in link 182 and rod 170 can move in its associated opening in lost motion link 182. FIG. 15 shows the working condition of the components with link 182 operatively engaged or bound to rod 170 for conjoint action via arm 184 to relieve pressure on the top newspaper on the stack on tray 160.

Thus, during pivoting of the link 175, the lost motion link 182 will be joined to the rod 170. The rod 170 will move downwardly and arm 184 secured to tray 160 will also be moved downwardly a small amount. The tray is moved downwardly a small amount to relieve the upward pressure on the top newspaper and thereby permit it to be more easily dispensed.

In operation of the newspaper vending machine 10, the pull knob 28 at the front of the vending component 12 is pulled toward the operator. The carriage 36 is moved forwardly and if there is insufficient money in the coin receiver 50 then the projection 54 on top of the carriage 36 will strike the lever 52 pivoted to the top panel of the newspaper vending machine 10. The operator will be unable to pull the carriage further and no newspaper can be dispensed.

In the event that there is sufficient coinage in the coin receiver 50, the pivoted lever 52 will be held out of engagement with the projection 54 on the top of the carriage and the carriage 36 may be moved forwardly. Cam 59 will cooperate with pin 58 for forcing the feed finger downwardly, into engagement with the top newspaper on the stack within the vending component 12. As the operator continues to pull the knob 28 forwardly, the newspaper is pivoted about the top of the stack and the end thereof extends forwardly through opening 30 where it may be grasped by the operator.

Toward the end of forward travel of the carriage 36, the cam 122 on the carriage 36 engages the pin 124 at the free end of the pivoted lever 52, forcing the lever 52 to the right and actuating the rod mechanism 116 connected thereto so as to permit the block or stop 118 at the lower end of the chute of the coin receiver 50 to move out of alignment with the chute and to permit the coins to drop into the receiver collecting receptacle 76. Lever 150 will be moved to the right as seen in FIG. 2 by carriage 36 to block operation of coin return lever 140 and prevent the user from improperly actuating the coin return mechanism.

Upon release of the knob 28 at the end of its forward cycle of motion, the return spring 38 will return the carriage 36 to its initial position. Locking lever 150 will be biased out of locking cooperation with the coin return lever 140. The operator continues to pull upon the newspaper and remove it from the newspaper vending machine 10 through opening 30.

When the last newspaper has been dispensed from the stack in the vending compartment 12, rod 62 pivoted on the top panel 35 will have its free end drop through an opening 66 in the top panel, permitting the transverse rod 67 resting thereon to drop downwardly. During forward movement of carriage 36, pin 58 will engage an end of rod 67 and pivot same to raise the left end 65, raising lever 68 (FIGS. 2 and 3). Lever 68 engages a latch 69 slideable in the door 18. Movement of the door latch 69 upwardly will cause pivoting of the door which retains the display newspaper and permits the display newspaper to drop from its display position to a position where it may be removed from the newspaper vending machine. Thus, all newspapers within the newspaper vending machine may be dispensed.

For daily operation, the daily/Sunday knob 98 on the inside wall of the vending component 14 is moved upwardly and for Sunday operation, the knob will be moved downwardly. When the knob is in the up position, newspapers may be dispensed whether money is put into the Sunday slot or into the daily slot. It is possible for the vending machine to accept coins for Sunday papers, say $0.50, in addition to the coins for a daily newspaper, say $0.15, and to vend a newspaper upon receipt of the preset value of coinage. When the daily/-Sunday knob 98 is in the Sunday or down position, then the newspaper can be vended only if the proper funds for a Sunday paper are inserted.

In the event there should be problems with the coins in the newspaper vending machine, then the coin return lever 31 may be actuated. Upon withdrawing of the coin return lever 31 from the front wall of the vending component 12, the lever 140 will pivot and raise the rod 142 to move the return chute 144 below the chute 84 into alignment with the end of the chute and thus, discharge the coins into return chute 144 for return to coin return slot 29 via coin return box 143. The coin can be removed through the return slot 29 in the front of the vending machine 10.

There has been provided by the present invention an improved single chute coin receiver for a newspaper vending machine that can operate reliably for extended periods of time and which can be relieved of a jam condition readily. Another feature of the present invention is to provide a newspaper vending machine with novel means for relieving some of the upward pressure on the top newspaper on a stack to facilitate dispensing of the newspaper from the newspaper vending machine.

While a preferred embodiment of the present invention has been described and illustrated, the invention should not be limited thereto, but may be otherwise embodied within the scope of the following claims.

What is claimed is:

1. A coin receiver for use with a newspaper or the like vending machine having dispensing means therein, comprising first and second frame members defining a chute for receiving coinage, said frame members being biased toward one another and being actuable away from one another to release coinage from the chute, lever means for extending into the chute to set the chute for receiving predetermined coinage, a receptacle for storing coinage, first actuating means operatively connected to one of said frame members for moving said frame member relative to the other frame member in response to actuation of the dispensing means to discharge the coinage into said receptacle, and second actuating means operatively connected to said one frame member for moving the said one frame member further relative to said other frame member.

2. A coin receiver as in claim 1 including a coin collection box disposed beneath the chute for receiving coinage therefrom.

3. A coin receiver as in claim 1 wherein the first actuating means includes an upright elongated rod having a block thereon adapted to be positioned below the chute to retain coinage in the chute and movable to a position out of alignment with the chute to permit coinage to be discharged from the chute.

4. A coin receiver as in claim 3 wherein the elongated rod is rotatably and reciprocably supported in the newspaper vending machine, cam means in the newspaper vending machine operable associated with said elongated rod, whereby when the elongated rod is urged downwardly during operation of the dispensing mechanism, the elongated rod will engage the cam means and be rotated to move the block on the elongated rod out of alignment with the chute and permit the coinage to be discharged from the chute.

5. A coin receiver as in claim 4 wherein the elongated rod has a projection thereon adapted to engage the said one frame member to actuate the said one frame member when the elongated rod is pivoted.

6. A coin receiver as in claim 3 wherein the second actuating means includes a coin return lever, second rod means reiprocably supported in said newspaper vending machine, said coin return lever being operatively connected to said second rod means, cam means carried on said second rod means, said cam means being adapted to engage said one frame member to move same from said other frame member.

7. A coin receiver as in claim 6 wherein a coin return chute is pivotally supported below the first and second frame members, said second rod means being connected to said coin return chute to actuate same, whereby when the coin return lever is pulled, said second rod means is raised and the cam means thereon urges the first and second frame members apart, and at the same time, said coin return chute moves the block out of alignment with the chute and pivots the elongated rod to move the first and second frame members fully away from one another, said coin return chute being aligned with said chute, whereby coinage may be discharged from the chute into the coin return chute for return to the operator.

* * * * *